United States Patent [19]

Hamada

[11] 4,388,849

[45] Jun. 21, 1983

[54] SIGNAL PROCESSING SYSTEM

[75] Inventor: Osamu Hamada, Tokyo, Japan

[73] Assignee: Sony Corporation, Tokyo, Japan

[21] Appl. No.: 119,642

[22] Filed: Feb. 8, 1980

[51] Int. Cl.[3] ..... G10H 3/06

[52] U.S. Cl. ..... 84/1.18; 84/1.01; 179/1.5 S; 371/30

[58] Field of Search ..... 84/1.01, 1.18; 178/22.04; 179/1.5 R, 1.5 S; 340/347 SH; 371/2, 30

[56] References Cited

U.S. PATENT DOCUMENTS

| | | | |
|---|---|---|---|
| 3,652,776 | 3/1972 | Milde, Jr. | 84/1.18 X |
| 3,800,058 | 3/1974 | Bartok et al. | 84/1.18 |
| 3,878,751 | 4/1975 | Golden et al. | 84/1.18 X |
| 3,885,110 | 5/1975 | Di Matteo | 84/1.18 X |
| 3,895,553 | 7/1975 | Kawamoto | 84/1.01 X |
| 3,970,790 | 7/1976 | Guanella | 179/1.5 S |
| 4,018,448 | 4/1977 | Di Matteo | 84/1.18 X |
| 4,100,374 | 7/1978 | Jayant et al. | 179/1.5 S |

OTHER PUBLICATIONS

Albert G. Franco, "Coding for Error-Free Communications," *Electro-Technology,* Science & Engineering Series #109, ©1968 by Conover-Mast Publications, Inc., Jan. 1968.

*Primary Examiner*—Stanley J. Witkowski

*Attorney, Agent, or Firm*—Hill, Van Santen, Steadman, Chiara & Simpson

[57] ABSTRACT

A signal processing system records and reproduces a music signal which varies repeatedly. The music signal is sampled at a given sampling period and pulse row obtained from the sampling is rearranged into a given pattern to achieve a new pulse row which is stored. For read out from a storage medium, a read-out means reproduces the original pulse row sequence and provides a wave form of the original music signal.

9 Claims, 23 Drawing Figures t1
t2
t3
tm-1
tm
To
To
To

S1-1
S1-2
S1-3
S1-M
SAMPLING PERIOD(T1)

S2-1
S2-2
S2-3
S2-M
SAMPLING PERIOD (T2)

S3-1
S3-2
S3-3
S3-M
SAMPLING PERIOD(T3)

Sm-1
Sm-2
Sm-3
Sm-M
SAMPLING PERIOD(Tn)

t1 t2 t3
tm-1 tm
To To
To

S1-1
S1-2
S1-3
S1-M
SAMPLING PERIOD(T1)

S2-1
S2-2
S2-3
S2-M
SAMPLING PERIOD(T2)

Sm-1
Sm-2
Sm-3
Sm-M
SAMPLING PERIOD(Tn)

P1
P2
Pm
S1-1
S2-1
Sm-1
S1-2
S2-2
Sm-2
S1-M
S2-M
Sm-M

S1-1
S1-2
S1-M
S2-1
S2-2
S2-M

ENVELOPE

SIGNAL PROCESSING SYSTEM

BACKGROUND OF THE INVENTION

1. Field of the Invention

This invention relates to a signal processing system which is best suited for a sound source for use in an electronic musical instrument or a voice synthesizing device and the like.

2. Description of the Prior Art

According to the prior art sound source device for use in an electronic musical instrument or a voice synthesizing device and the like, a vibratory wave form signal from a mechanical sound producing body or an electrical oscillator is derived as a music signal directly or via a demultiplier or a filter circuit, or a signal wave form or an envelope wave form and the like of a music signal are stored in a memory means, and then the contents thus stored are read out digitally, thereby reproducing a music signal.

For instance, in the case of an electronic musical instrument equipped with an oscillator, a filtering characteristic of a filter circuit is controlled, or two or more oscillating signals are synthesized, thereby deriving a given wave form or spectrum, and in addition, the music signal thus derived is envelope-controlled, thereby obtaining a percussion tone.

Meanwhile, it is difficult to derive a music signal such as are produced by a piano, whose higher harmonic frequency is not an integer-multiplication of a basic frequency and yet spectral construction varies with the time.

For instance, with a music synthesizer equipped with a voltage control type filter, it is possible to vary, relative to the time, the spectral construction of a music signal which may be derived by controlling the filter characteristic relative to the time. However, a massive construction is required for an apparatus for playing a complex sound such as those of a piano. Hitherto, there is known an electronic musical instrument, as a sound source device equipped with memory means, wherein actual music is stored in a magnetic tape or an optical disc and the like, and then music signals stored in response to the operation of keys in a keyboard are read out and reproduced. Such a prior art musical instrument is complicated in construction, and has to be subjected to a time limitation imposed on the music obtained, thus failing to accommodate itself to speedy play or play wherein one sound is continued for a long duration, or to obtain a music signal whose spectral structure is varied relative to the time.

SUMMARY OF THE INVENTION

It is an object of the present invention to provide a novel processing system for a music signal which avoids the shortcoming experienced with the prior art electronic musical instrument, and may simply reproduce a music signal which varies relative to the time.

It is another object of the present invention to provide a signal processing system, wherein a wave form of an actual music signal is sampled by using a sampling pulse at a given sampling period, and then a pulse row thus obtained is rearranged into a given pattern, thereby providing a new pulse row, and reproducing a wave form of an original signal from the aforesaid new pulse row.

It is a further object of the present invention to provide a signal processing system which may accurately reproduce even such a signal which affords non-harmonic sound such as the music of a piano, and whose spectral structure varies relative to the time.

It is a still further object of the present invention to provide a signal processing system which allows the selective reading of two or more signals recorded in a rotary recording medium.

These and other objects, features and advantages of the invention will be apparent from a reading of the ensuing part of the specification in conjunction with the accompanying drawings which indicate the embodiments of the invention.

According to the present invention, there is provided a signal processing system, comprising: means for deriving pulse signals ($S_{1-1}$, $S_{1-2}$, . . . $S_{1-m}$), ($S_{2-1}$, $S_{2-2}$, . . . $S_{2-m}$), . . . ($S_{m-1}$, $S_{m-2}$, $S_{m-M}$) by selecting a given repeating period for an original signal which varies repeatedly, and by sampling the signal in each period at every timing, tm, respectively, and means for obtaining a series of pulse row signals ($P_1$, $P_2$, . . . $P_m$) by rearranging pulse signals obtained at every timing tm in the order of ($S_{1-1}$, $S_{2-1}$, . . . $S_{m-1}$) ($S_{1-2}$, $S_{2-2}$, . . . $S_{m-2}$) . . . ($S_{1-M}$, $S_{2-M}$, . . . $S_{m-M}$).

DESCRIPTION OF THE PREFERRED EMBODIMENTS

The present invention is directed to providing a processing system for a music signal, which system may simply reproduce a wave form of an original signal from a new pulse row, by sampling a wave form of an actual music signal (original signal) by using a sampling pulse at a given sampling period, and then rearranging the pulse row thus obtained in a given pattern, thereby providing the new pulse row.

Figures 2A, 2B, 2C, 2N:
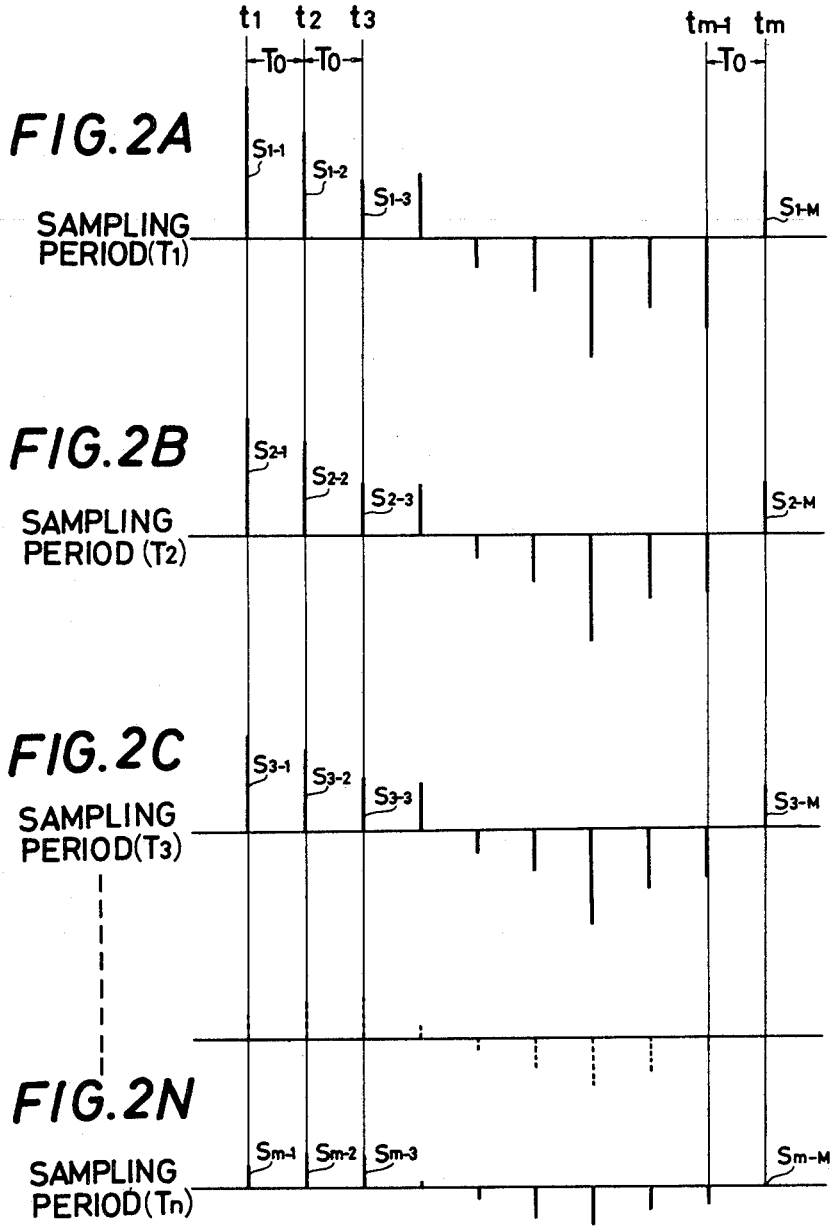
FIGS. 2A to 2N are diagrams showing the rearrangement of pulse rows in the embodiment of FIG. 1.
Figure 10A:
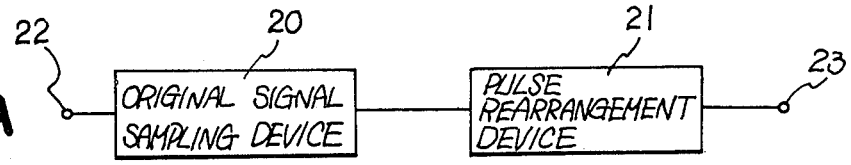
FIG. 10A is a block diagram showing one embodiment of an apparatus for sampling an original signal as shown in FIGS. 1 and 5 and the pulse row rearrangement as shown in FIGS. 3 and 7.

The present invention will now be described in more detail. First, a wave form of an original signal is sampled in the following manner. Sampling is effected at every timing tm [tm=(m-1) To, where To as shown in FIGS. 2A, B, C . . . n" is the time duration between each timing and wherein m=1, 2, 3, . . . m] during each sampling period Tn [Tn=L.Tnp, wherein Tnp is the time duration of one signal frequency period, n=1, 2, 3, . . . n, and L=1, 2, 3, . . . L], included in a rest period Tn' (Tn'=K.Tnp, wherein K is an integer such as 0, 1, 2, . . . K), by using a sampling frequency f [sampling period To (To=1/f)] which is dependent on a maximum repeating frequency fH and a minimum repeating period TL of an original signal; and then a pulse row having a total of M sampling values during every sampling period Tn may be obtained. The integer L defines the number of signal cycles desired during a sampling period and the integer K defines the number of signal cycles during a rest period. As shown in FIG. 10A, an original signal sampling device 20 creates the pulse row when an original signal is fed in at 22.

The aforesaid sampling frequency f is determined in the following manner. For reproducing a wave form of an input signal by using a pulse row obtained by sampling a wave form of an input signal, it is mandatory to use a sampling pulse of a sampling frequency at least twice the maximum repeating frequency of the input signal. Accordingly, the sampling frequency f according to the present invention is so designed as to synchronize with the minimum repeating period TL of an original signal and to be at least twice the maximum repeating frequency fH of the original signal.

For instance, in case an original signal has a spectral structure which varies relative to the time, as in the music of a piano, the aforesaid minimum repeating period TL=1/27.500 (basic frequency 27.500 HZ), assuming that the original signal represents the lowest sound Ao of a piano, i.e., substantially the minimum repeating period. In addition, a substantially maximum repeating frequency dependent on the magnitude of harmonic to be reproduced, relative to a basic sound, may be used as the aforesaid maximum repeating frequency fH, while taking into consideration the non-harmonizable characteristic of an original signal.

Figure 1:
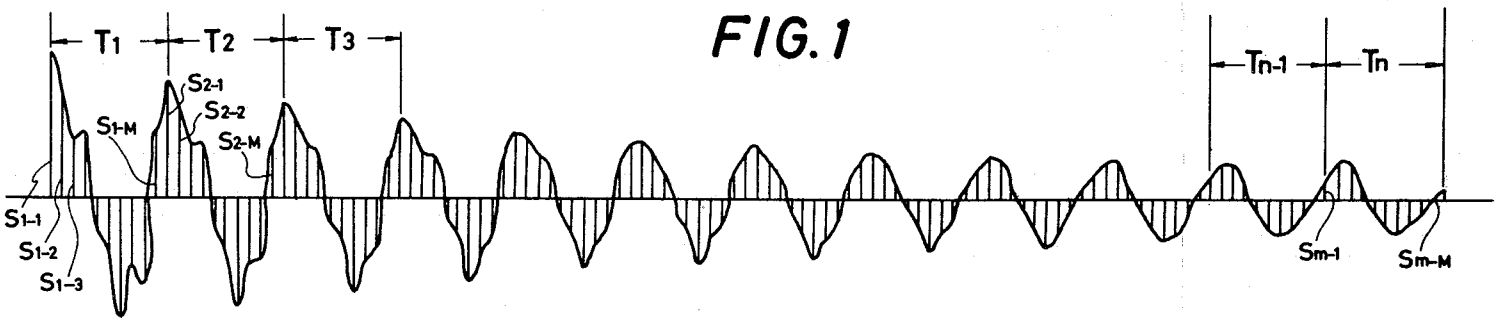
FIG. 1 is a view showing one embodiment of the invention which is illustrative of the sampling condition of an original signal in a signal processing system.

FIG. 1 shows the condition of sampling of a wave form of a music signal which varies relative to the time, in the case where K=0, and L=1 (one cycle per sampling period without a rest period). The signal shown in FIG. 1 is enlarged at every sampling period in FIGS. 2A, B, C . . . n, which show each sampling period in detail. During the sampling period T1 (FIG. 2A), sampling is effected at every timing $t_1$, $t_2$, . . . tm to provide pulse signals ($S_{1-1}$, $S_{1-2}$, . . . $S_{1-M}$). On the other hand, for signals during the sampling period T2 (2B), sampling is effected at every timing $t_1$, $t_2$, . . . $t_m$ to provide pulse signals ($S_{2-1}$, $S_{2-2}$, . . . $S_{2-M}$). In the similar manner, as shown in FIGS. 2C to 2N, signals are sampled during every sampling period Tn, and then pulse signals ($S_{3-1}$, $S_{3-2}$ . . . $S_{3-M}$) and ($S_{m-1}$, $S_{m-2}$, . . . $S_{m-M}$) are obtained. Thus, a new pulse row may be obtained from pulse row series P1 of pulse signals ($S_{1-1}$, $S_{2-1}$, $S_{3-1}$, . . . $S_{m-1}$) at every timing t1 of each sampling period T1, T2 . . . Tn (T1=T2=T3 . . . Tn), as well as from pulse row series Pm of pulse signals ($S_{1-m}$, $S_{2-m}$, $S_{3-m}$, . . . $S_{m-M}$) at every timing tm which are arranged in the order shown in FIG. 3.

The aforesaid rearrangement of the pulse row may be accomplished with ease by using a digital memory and the like. As shown in FIG. 10A, the original signal sampling device 20 feeds the pulse row to a rearrangement device 21 (discussed below) which may include said digital memory in order to create the rearranged pulse row at output 23.

In case sampling is further effected by using a sampling pulse having a pulse width of Tno/M and a period Tno (Tno corresponds to the sampling period Tn of the original signal), while controlling the phase relationship between the aforesaid new pulse row and aforesaid sampling pulse, then there may be read out a pulse row the same as the pulse row obtained from an original signal by sampling with the lapse of time, so that a wave form of an original signal may be reproduced.

Figure 10:
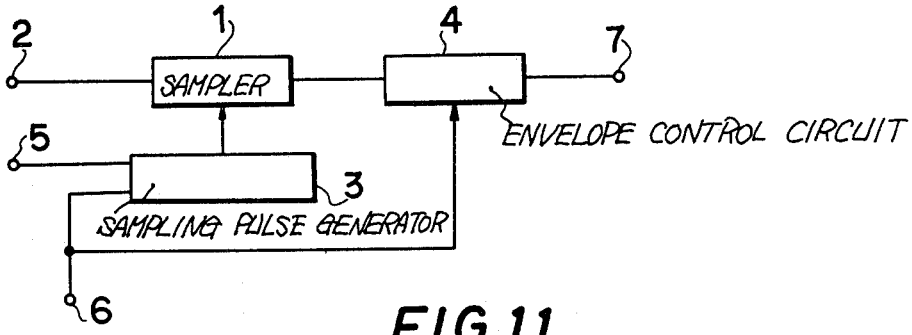
FIG. 10 is a block diagram showing one embodiment of the reproducing apparatus for reproducing an original signal from the pulse row obtained according to the present invention.
Figure 11:
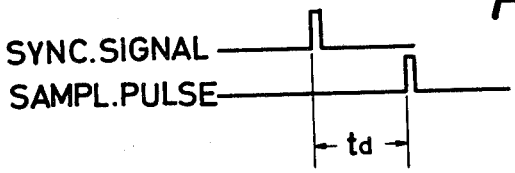
FIG. 11 is a view showing the operation of the reproducing apparatus of FIG. 10.

As shown in FIG. 10, for reconstruction of the original signal, a sampler 1 samples a pulse row contained in the aforesaid input signal in response to a sampling pulse from a sampling pulse generating circuit 3. The rearranged pulse row is supplied via a first input terminal 2. Then the sampler 1 supplies the output signal to an envelope controlling circuit 4. In addition, when a synchronizing signal having a repeating period Tno corresponding to one sampling period Tn upon sampling of an original signal is supplied from a second input terminal 5, a starting signal to instruct the starting of reproduction is supplied from a third input terminal 6. Then, the aforesaid sampling pulse generating circuit 3 starts the operation in response to the aforesaid starting signal, thereby generating a sampling pulse which is delayed by the time td corresponding to the time duration required for the sampling of an original signal. In this respect, FIG. 11 shows a variation of the delay time td of a sampling pulse, as compared with a synchronous pulse in the sampling pulse generating circuit 3. Meanwhile, the aforesaid delay time td does not lead to the aforesaid repeating period Tno.

The aforesaid starting signal is supplied to the aforesaid envelope controlling circuit 4, and then the operation thereof is commenced in response to the starting signal, thereby supplying a signal to an output terminal 7, which signal may be obtained by subjecting an output signal from the sampler 1 to the envelope control.

Figure 3:
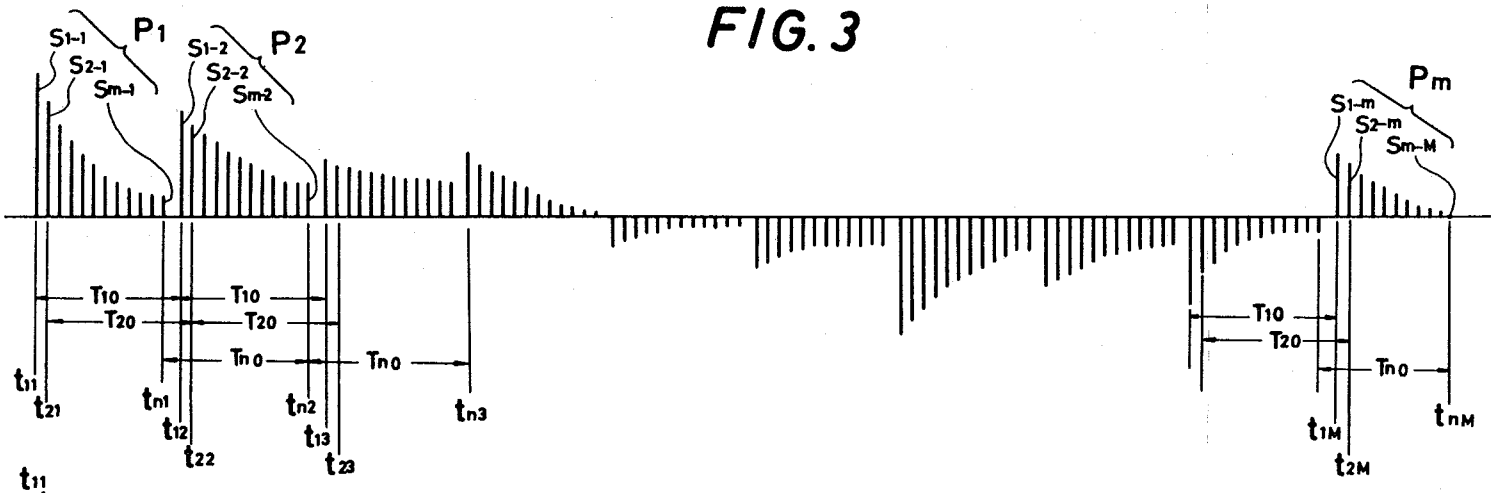
FIG. 3 is a diagram showing the rearrangement of pulse rows obtained by the rearrangement in the embodiment of FIG. 1.
Figure 4:
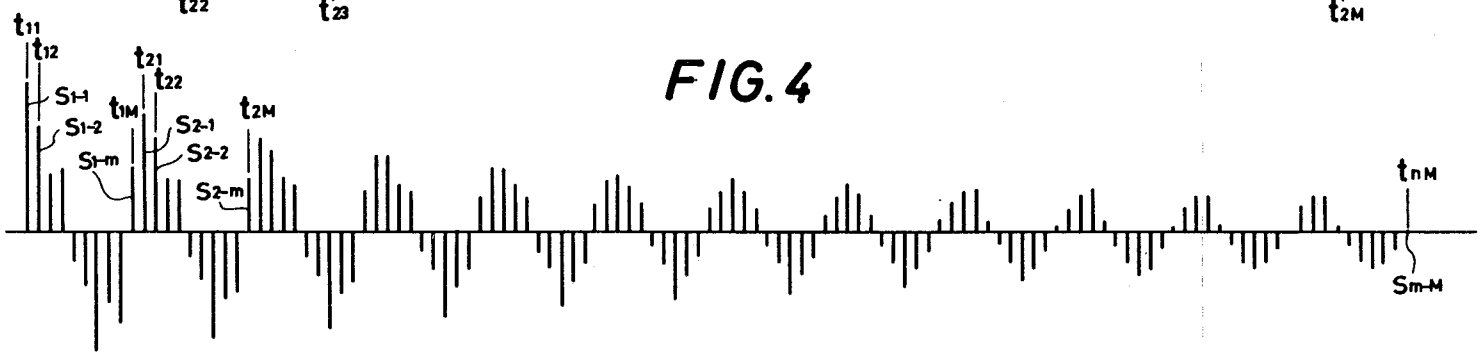
FIG. 4 is a diagram showing a pulse row obtained, upon reproduction for the embodiment of FIG. 1.
Figures 6A, 6B, 6N:
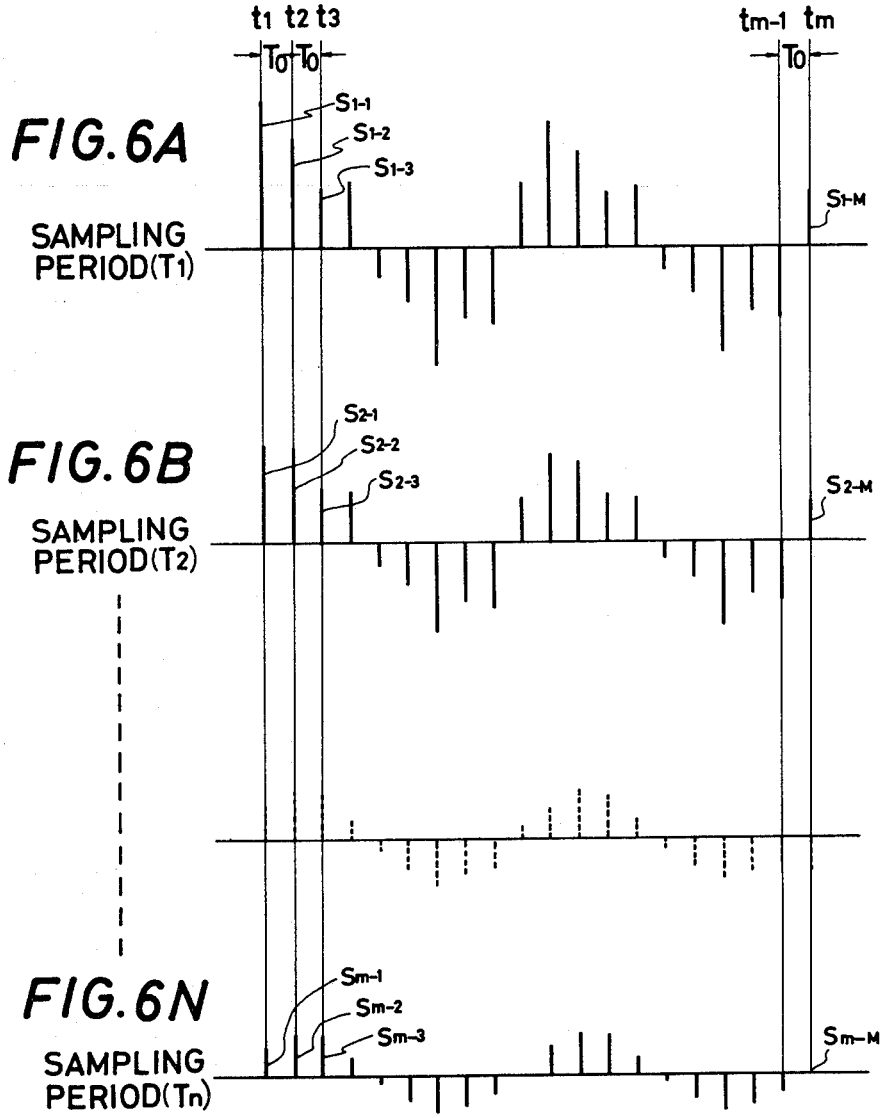
FIGS. 6A to 6N are diagrams showing the rearrangements of pulse rows in the embodiment of FIG. 5.

Thus, when a rearranged pulse row as shown in FIG. 3 and obtained according to the present invention is supplied to the first input terminal 2 of the reproducing apparatus of the aforesaid arrangement, then the sampler 1 effects sampling sequentially at the timings t11, t12, . . . t1M at every repeating period T10, which is dependent on synchronizing pulses, and then at the timings t21, t22, . . . t2M at every repeating period Tno, thereby providing outputs as shown in FIG. 4. In this respect, the pulse row shown in FIG. 4 is the same as the pulse row obtained due to the sampling of an original signal shown in FIG. 1. Accordingly, a wave form of an original signal may be reproduced by using an output of the sampler 1. In this case, the envelope controlling circuit 4 effects the control of a level of a pulse row the same as the pulse row obtained due to sampling of an original signal obtained by the sampler 1, i.e., the control of the amplitude (strong or weak) of a music signal to be reproduced.

FIGS. 5 to 9 show examples wherein sampling is effected at K=1, and L=2. The signals during the sampling periods T1, T2, . . . Tn are shown enlarged in FIGS. 6A to 6N. As in the case of the signal in FIG. 2A, B, C . . . , sampling is effected at every timing t1, t2, . . . tm during the sampling period T1, and then pulse signals $S_{1-1}$, $S_{1-2}$, . . . $S_{1-M}$ may be obtained. In addition, sampling is effected at every timing t1, t2, . . . tm during the period T2, and then pulse signals $S_{2-1}$, $S_{2-2}$, . . . $S_{2-M}$ may be obtained.

Figure 7:
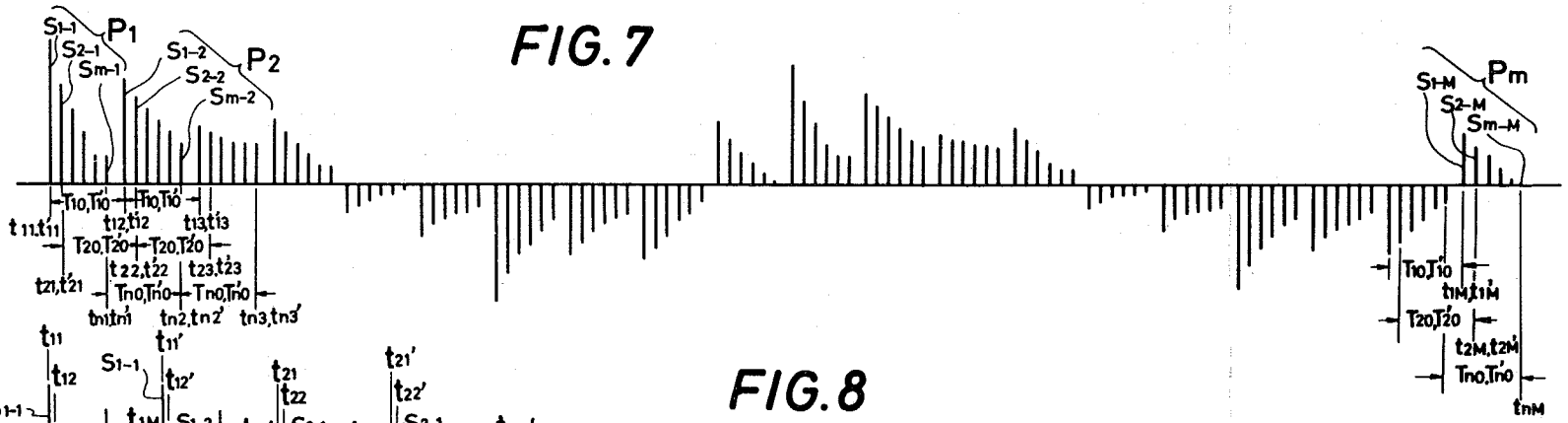
FIG. 7 is a diagram showing the rearrangement of a pulse row obtained according to the rearrangement in the embodiment of FIG. 5.

In a manner similar thereto, pulse signals $S_{m-1}$, $S_{m-2}$, . . . $S_{m-M}$ may be obtained during the sampling period Tn. These pulse signals are converted, for instance, by using a typical digital memory well-known in the prior art, into a pulse row series Pm consisting of a pulse row series P1 of pulse signals ($S_{1-1}$, $S_{2-1}$, . . . $S_{m-1}$) at the timing t1 during each sampling period, as shown in FIG. 7, a pulse row series P2 of pulse signals ($S_{1-2}$, $S_{2-2}$, . . . $S_{m-2}$) at each timing t2, and pulse signals ($S_{1-M}$, $S_{2-M}$, . . . $S_{m-M}$) at each timing tm. As the sample pulses are created, they are simply stored in the memory as the pulse row series Pm defined herein.

Figure 14A:
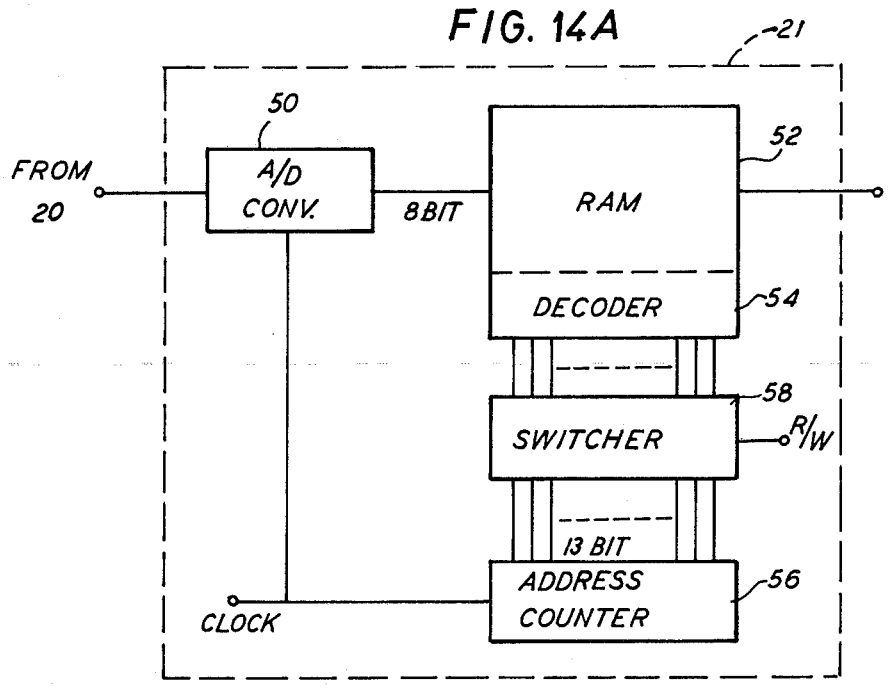
FIG. 14A is a block diagram of the pulse rearrangement device of FIG. 10A.

The lay-out and operation of the pulse rearrangement device 21 is most easily understood by FIGS. 14A, B, C. Many different types of systems can be employed for rearranging the pulses according to the invention and as disclosed previously. Once one skilled in the computer or logic art is shown the pulse rearrangement pattern of this invention, then construction of appropriate hardware follows therefrom.

Specifically, in FIG. 14A in the preferred embodiment the analog to digital converter 50 converts during write time the sampled signal derived from the device 20 into a digital signal of, for example eight bits. This eight bit data is supplied to the random access memory (RAM) 52. At this moment, address signals are supplied to RAM 52 through switcher 58 switched in the mode shown in FIG. 14B and decoder 54 from the address counter 56 of, for example, thirteen bits. Thus, the digital signals are successively memorized on memory cells of RAM 52. These digital signals would be read into the memory in the sequence shown in FIG. 1, for example.

Figure 14B:
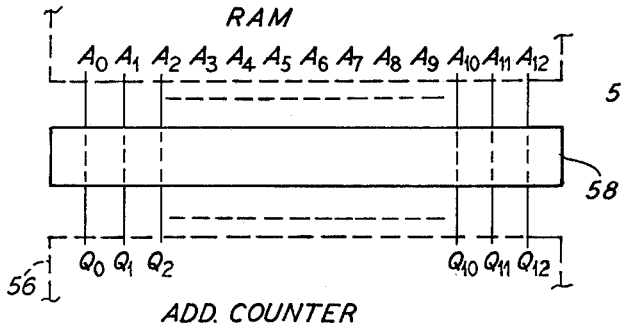
FIG. 14B is a block diagram showing connection lines for the switcher 58 shown in FIG. 14A during "write"
Figure 14C:
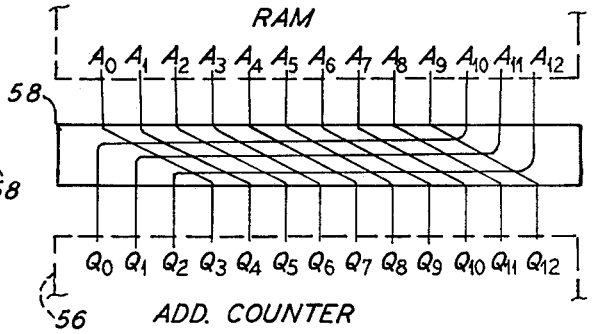
FIG. 14C is a block diagram showing the rearranged connections of the switcher 58 of FIG. 14A during "read-out"

During read-out, address lines are changed by the switcher 58 to the mode shown in FIG. 14C so that the address signals successively address $S_{1-1}$, $S_{2-1}$, . . . $S_{m-1}$, $S_{1-2}$, $S_{2-2}$, . . . $S_{m-2}$, $S_{1-M}$, . . . $S_{m-M}$. The switcher may be easily constructed by those skilled in this art in a variety of ways so as to accomplish the rearranged bits as shown. These rearranged bits, when fed to the decoder 54, then appropriately address the memory locations so as to read out the rearranged pulse row of FIG. 3, for example.

FIGS. 14B and 14C show the circuit paths in the switcher between RAM/DECODER outputs $A_0$-$A_{12}$ and ADDRESS COUNTER inputs $Q_0$-$Q_{12}$ in the switcher before and after switching.

Figure 8:
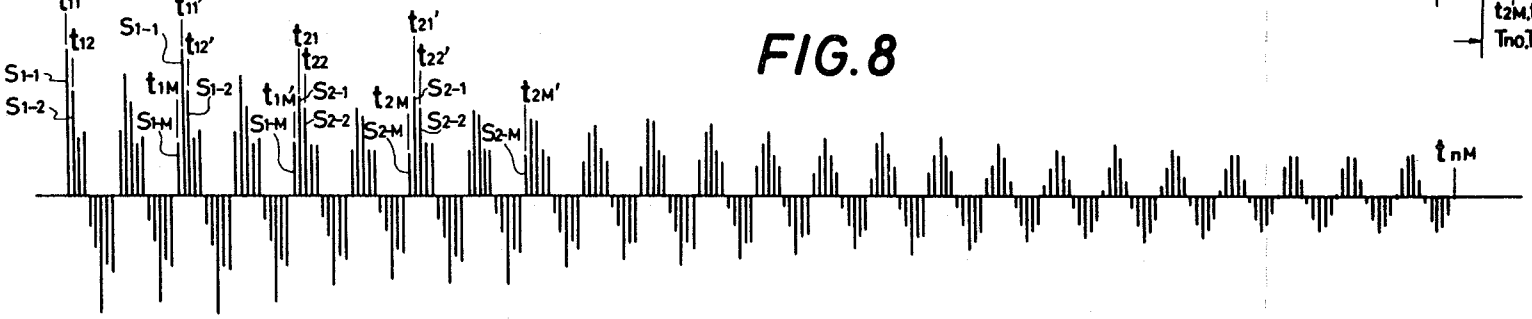
FIGS. 8 and 9 are diagrams showing pulse rows obtained, upon reproduction in the embodiment of FIG. 5.

In case an input signal having a pulse row as shown in FIG. 7 is supplied to the first input terminal 2 of the aforesaid reproducing apparatus, then the sampler 1 effects sampling by sampling a pulse row during the sampling period $T_{n-1}$ corresponding to a rest period Tn' in the sampling of an original signal at the timings (t11, t12, . . . t1M) at every period T10 corresponding to the sampling period T1 in the sampling of an original signal, then at the timings (t11', t12', . . . t1M') at every period T10' corresponding to the rest period T1', and then at the timings (t21, t22, . . . t2M) at every period T20 corresponding to the sampling period T2, and then at the timings (t21', t22', . . . t2M') at every period T20' corresponding to a rest period T2', until the period Tno becomes equal to the sampling period Tn, so that the sampler 1 may generate a pulse row as shown in FIG. 8.

Figure 9:
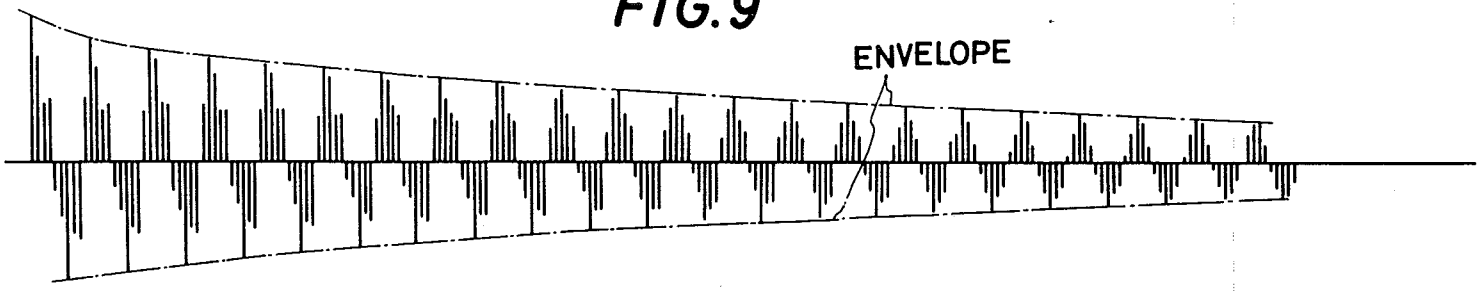

Then, the envelope controlling circuit 4 provides at an output terminal 7 a pulse row which may reproduce a wave form of an original signal as shown in FIG. 9, by subjecting the signals, as shown in FIG. 8 and provided from the sampler 1, to the envelope control corresponding to the envelope characteristic of an original signal.

As has been described earlier, a wave form of a music signal reproduced by using a pulse row to be processed according to the present invention is the same as a wave form of an original signal which has been sampled first when forming the aforesaid pulse row, so as to accurately reproduce the signal which has a non-harmonizable characteristic, as in the case of the music of a piano, and whose spectral structure varies relative to the time.

Upon the reproduction of an original signal according to the pulse row obtained according to the present invention, when sampling is effected at least twice sequentially at every period T10, T20, . . . TMo, then an envelope control is applied to the pulse row thus obtained, and then the duration of a music signal to be reproduced may be extended. In addition, the duration of a music signal to be reproduced may be shortened.

Accordingly, there may be achieved an electronic music instrument free of shortcomings of the prior art electronic music instrument by providing a pulse row of the music of a desired music instrument according to the music-signal-processing system of the invention, then recording the respective pulse rows in a recording medium and then reproducing the wave form of the music from the pulse rows by using a reproducing apparatus of the aforesaid arrangement. In this respect, in case an endless recording medium such as a disc is used as the aforesaid recording medium, then the rotational period thereof is determined by the relationship between the minimum frequency of music and a frequency resolving power. In other words, taking the music of a piano as an example, for reproducing the lowest sound Ao (27.500 HZ) at a frequency resolving power of 1%, the period will be $1/27.500 \times 100 = 3.6365$ seconds. In the case of the lowest sound Ao, a pulse signal corresponding to 100 wave lengths may be recorded in one period, and in the case of the highest sound $C_8$ (4186.0 HZ), a pulse signal corresponding to 15222 wave lengths may be recorded.

Figure 12:
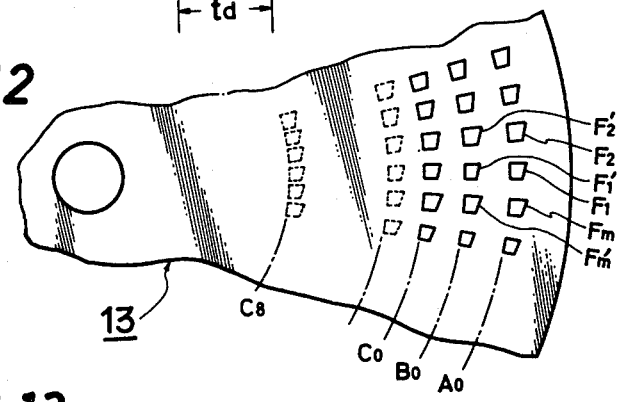
FIG. 12 is a plan view of a recording medium, in which a pulse row is recorded on an optical film.

Description will be given of a pattern to be recorded on the optical film 13 with reference to FIG. 12, taking as an example the case of an electronic piano by using a pulse row, as shown in FIGS. 3 or 7, as a time dividing signal.

For instance, respective pattern elements F1, F2, . . . Fm of a substantially trapezoid shape, which elements are formed to correspond to series of pulse rows P1, P2, . . . Pm as shown in FIG. 3, are arranged in order along the circumferential direction of the optical film 3. The changing height of the trapezoid in the radial direction of the disc corresponds to the pulse height change for each pulse row. On music sound is represented by respective pattern elements arranged on the same circumference, and respective pattern elements representing respective musical sounds of a piano are arranged on respective circumferences Ao, Bo, . . . C8, with the radial direction being taken as a musical scale. Meanwhile, respective pattern elements F1', F2', . . . Fm' corresponding to respective pattern elements F1, F2, . . . Fm arranged on respective circumference Ao, Bo, . . . C8 are arranged in the same radial direction. In other words, respective pattern elements are positioned on the optical film 13 radially. In addition, light may pass through a substantially trapezoid region of the respective pattern elements.

Figure 13:
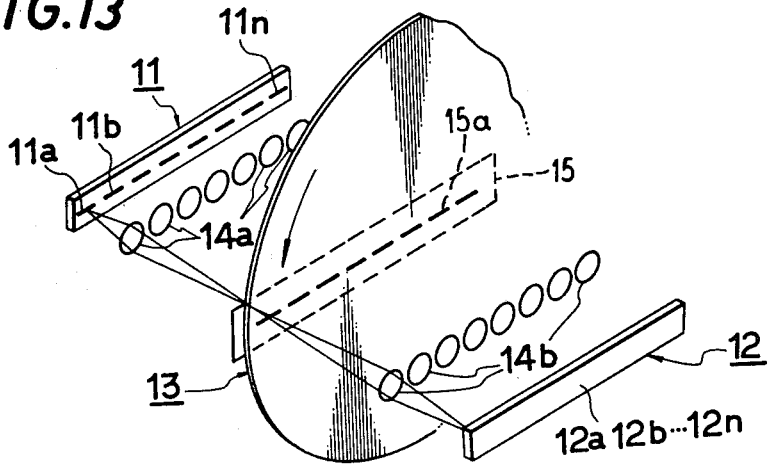
FIG. 13 is a perspective view of a read-out device for reading out a pattern recorded on the film as shown in FIG. 12.
Figure 15:
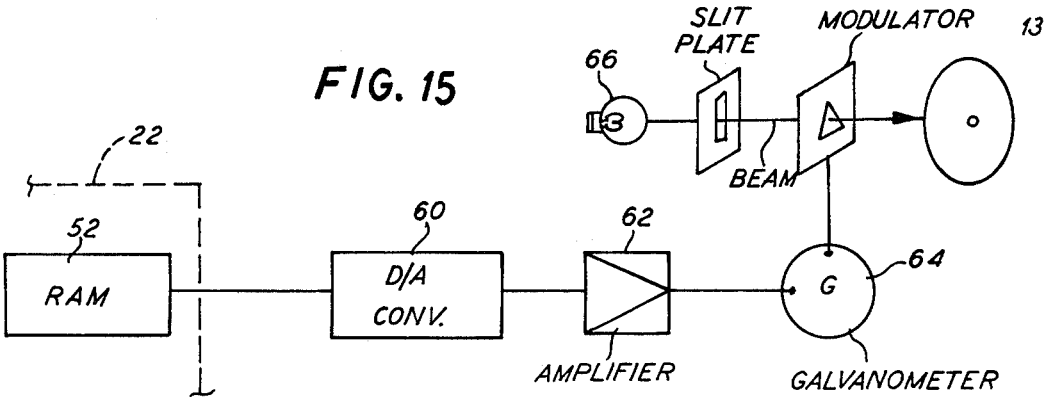
FIG. 15 is a block diagram illustrating a system for recording the signals derived from the pulse rearrangement device on the disc 13 shown in FIG. 12.

For recording the pattern elements on the optical film 13, the following system shown in FIG. 15 is employed. The output from RAM 52 is supplied to digital to analog converter 60 and then amplified by amplifier 62. The analog signal is supplied to a galvanometer 64 for modifying the beam from a light source 66. The modified beam is recorded on a film 13 as shown in FIG. 12 or FIG. 13.

The aforesaid film is positioned between the luminescent means 11 and light receiving means 12.

The luminescent means 11 consists of a series of luminescent elements 11*a*, 11*b*, . . . 11*n*, such as a luminescent diode array, in which two or more luminescent diodes are arranged in series, while the light receiving means 12 consists of a series of luminescent elements 12*a*, 12*b*, . . . 12*n*, such as a photodiode array in which two or more photodiodes are provided in series in opposed relation to the former luminescent elements. An optical film 13 of disc form is provided as a rotary recording medium, on which are recorded a plurality of time dividing signals as a pattern of a pulse width modulating mode. This is located between the luminescent means 11 and light receiving means 12. In addition, there are provided a first focusing lens group 14*a* adapted to focus the light emitted from the aforesaid luminescent means 11 onto the optical film 13, and a second focusing lens group 14*b* adapted to focus the light transmitted through the optical film 13 onto the light receiving elements 12*a*, 12*b*, . . . 12*n*.

The light emitted from the aforesaid series of luminescent elements 11*a*, 11*b*, . . . 11*n* are focused on the optical film 13 in a slit form in the radial direction of the optical film 13 via the first focusing lens group 14*a*. The bright line obtained by focusing the light on the optical film 13 in slit form may be obtained through a light shielding plate 15 having slits 15*a* or a window, in the front of or rear of the first focusing lens group 14*a*. The provision of the aforesaid series of luminescent elements 11*a*, 11*b*, . . . 11*n* in the form of line light source, respectively, permit the focusing of the light in an extremely narrow slit form (width . . . on the order of one m). The luminescent diode element which may be used as a line light source has been already developed. At the present time, two or more luminescent diodes serving as the aforesaid series of luminescent diodes and two or more photodiodes serving as a series of light receiving elements 12*a*, 12*b*, . . . 12*n* may be manufactured in pairs.

In the embodiment of the aforesaid arrangement, when respective luminescent elements 11*a*, 11*b*, . . . 11*n* emit the light selectively, while controlling the phase thereof in synchronism with a synchronous signal having a repeating period equal to a ratio of (rotational period of a rotary recording medium)/(number of pattern elements positioned on the same circumference), then signals capable of reproducing a desired music from respective elements representing respective sounds recorded on circumferences Ao, Bo, . . . C8 on the optical film 13 may be derived from the light receiving elements opposed to the luminescent elements which have emitted the light. For instance, for reading of the pattern elements F1, F2, . . . F, on the circumference Ao of the optical film 13, the control is effected commensurate to the time lapse of the luminescent timing of luminescent element 11*a* from the start of the operation of keys (not shown), and then timing of the respective pattern elements F1, F2, . . . Fm passing through the bright line obtained when the light emitted from the luminescent element 11*a* is focused via a focusing lens 14*a*, are controlled in the following manner.

In other words, the control of a luminescent timing of the luminescent elements 11*a* is effected in a manner that the respective pattern elements F1, F2, . . . Fm on the optical film 13 may sequentially pass through the aforesaid bright line at timing t11, t12, . . . t1M at every repeating period during the first rotation of the optical film 13, at timings t21, t22, . . . t2M at every repeating period T20 during the second rotation of the film 13, and at the timings tn1, tn2, . . . tnM at every repeating period Tno during the nth rotation. When the luminescent timings of the luminescent element 11*a* is controlled in the aforesaid manner, a pulse row serving as a reading signal obtained at the luminescent element 12*a* becomes equal to the pulse row obtained by sampling an original signal shown in FIG. 1, so that the original signal may be reproduced, as shown in FIG. 3.

Figure 5:
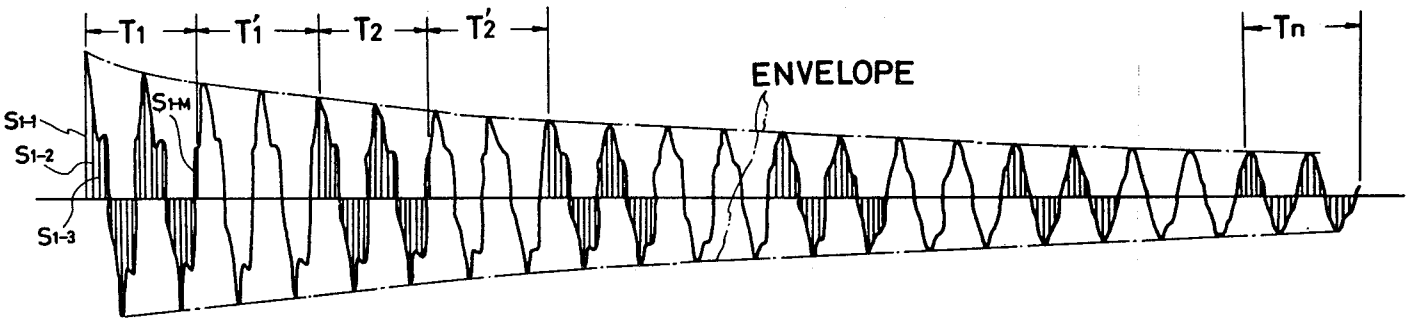
FIG. 5 is a diagram showing a sampling condition of an original signal in another embodiment of the invention.

The pattern of the output from the light receiving member 12 is substantially the same as the pattern of FIGS. 1 or 5. This corresponds to sampler 1 and terminal 2 in FIG. 10.

In this connection, the time required for reading may be shortened by using elements having a good frequency characteristic, such as luminescent diodes and photodiodes serving as the aforesaid luminescent elements and light receiving elements.

Accordingly, in the aforesaid embodiments, signals capable of reproducing a desired music may be read out by selectively causing the respective luminescent elements to emit the light.

Meanwhile, description has been given to the aforesaid embodiments, wherein time dividing signals are recorded on an optical film in a pulse width modulating mode. Alternatively, time dividing signals may be recorded by utilizing gradation for the transmitivity of light, i.e., for high and low density, or time dividing signals may be recorded in a pulse code modulating mode.

As is apparent from the foregoing description, there may be obtained pulse rows capable of accurately reproducing music signals which vary relative to the time, and music signals whose spectral structure varies relative to the time and which have a non-harmonizable characteristic may be reproduced while controlling its duration. Accordingly, intended objects may be achieved to satisfaction.

For construction of the pulse rearrangement device of FIG. 14A, the switcher 58 may be constructed of a plurality of quad 2 line to 1 line data selectors, part number 74157 of Texas Instruments, Inc. With this switcher, the RAM 52 and decoder 54 may be constructed of part number 2114 of INTEL, Inc. This part is an integrated circuit and sixteen of them are used. In order to insure sufficient decoder capability, an additional decoder part number 74138 of Texas Instruments supplements the decoding capacity of circuit 2114.

The above components are readily available through catalogues from the above companies and have been known in the art for some time.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A music signal processing system comprising:

an original music signal having a given frequency;

means for deriving pulse signals arranged in pulse signal groups ($S_{1-1}$, $S_{1-2}$, . . . $S_{1-M}$), ($S_{2-1}$, $S_{2-2}$, . . . $S_{2-M}$), . . . ($S_{m-1}$, $S_{m-2}$, . . . $S_{m-M}$) by selecting a given sampling period Tn for the original music signal such that an integer multiple number of the music frequency cycles occurs during each sampling period, and by sampling the signal in each sampling period Tn at every timing tm which defines a sampling frequency f where f is at least twice the given frequency of the music signal and wherein the timings tm are synchronized with the music signal sampling periods Tn, where for $S_{m-M}$, m represents one of the sampling periods Tn during which sampling is occurring and M represents one of the timings tm during one of the sampling periods Tn when sampling is occurring; and means for obtaining a series of rearranged pulse row signal groups $P_1$, $P_2$ . . . $P_m$ by rearranging said pulse signals obtained at every timing tm in the order of ($S_{1-1}$, $S_{2-1}$, . . . $S_{m-1}$)($S_{1-2}$, $S_{2-2}$, . . . $S_{m-2}$) . . . ($S_{1-m}$, $S_{2-m}$, . . . $S_{m-M}$) respectively corresponding to said pulse row signal groups $P_1$, $P_2$, . . . $P_m$.

2. A signal processing system as set forth in claim 1, wherein said system further comprises a recording medium adapted to record said rearranged pulse row groups.

3. A signal processing system as set forth in claim 2, wherein means are provided for reading out said rearranged pulse row groups recorded on said recording medium sequentially at a given phase difference.

4. A signal processing system as set forth in claim 2, wherein said recording medium is an optical film of disc form, and said rearranged pulse row groups are recorded sequentially at a same circumference track in an endless fashion.

5. A signal processing system as set forth in claim 4, wherein said optical film is concentric with said rearranged pulse row groups, and has a musical scale of signal patterns recorded in the radial direction of the optical film disc.

6. A signal processing system as set forth in claim 4, wherein said system further comprises luminescent means and light receiving means which are opposed to each other with said optical film being interposed therebetween, said luminescent means comprising a plurality of luminescent elements such that signals recorded on said optical film may be read out by said light receiving elements according to a repeated luminescent control at every sampling period (T1, T2, . . . Tn).

7. A signal processing system as set forth in claim 6, in which apertures are formed in the optical film such that their shape is representative of a group of said rearranged pulse row groups and wherein slit means are provided for directing a line of light on said apertures so as to scan a change in shape thereof.

8. A method for processing a music signal, comprising the steps of:

providing an original music signal having a given frequency;

deriving pulse signals arranged in pulse signal groups ($S_{1-1}$, $S_{1-2}$, . . . $S_{1-M}$), ($S_{2-1}$, $S_{2-2}$, . . . $S_{2-M}$), . . . ($S_{m-1}$, $S_{m-2}$, . . . $S_{m-M}$) by selecting a given sampling period Tn for the original music signal such that an integer multiple number of the music frequency cycles occurs during each sampling period, and by sampling the signal in each sampling period Tn at every timing tm, respectively where for $S_{m-M}$, m represents one of the sampling periods Tn during which sampling is occurring and M represents one of the timings tm during one of the sampling periods Tn when sampling is occurring; and obtaining a series of rearranged pulse row signal groups $P_1$, $P_2$ . . . $P_m$ by rearranging said pulse signals obtained at every timing tm in the order of ($S_{1-1}$, $S_{2-1}$, . . . $S_{m-1}$) ($S_{1-2}$, $S_{2-2}$, . . . $S_{m-2}$) . . . ($S_{1-m}$, $S_{2-m}$, . . . $S_{m-M}$) respectively corresponding to said pulse row signal groups $P_1$, $P_2$, . . . $P_m$.

9. The method of claim 8 further including the steps of providing the sampling at every timing tm wherein for a sampling frequency f which is defined by a timing tm, f is chosen at least twice the given frequency of the music signal and wherein the timings tm are synchronized with the music signal sampling periods Tn.

* * * * *